US005615819A

United States Patent [19]

Hou et al.

[11] Patent Number: 5,615,819

[45] Date of Patent: Apr. 1, 1997

[54] NAIL MAGAZINE STRUCTURE OF A POWER NAILER

[76] Inventors: Chang Feng-Mei Hou; Ming-Ta Wei, both of No. 52, Alley 17, Lane 20, Chung-Shan Road, Tai-Ping Hsiang, Taichung Hsien, Taiwan

[21] Appl. No.: 538,720

[22] Filed: Oct. 3, 1995

[51] Int. Cl.[6] ..... B25C 1/04

[52] U.S. Cl. ..... 227/109; 227/120

[58] Field of Search ..... 227/109, 119, 227/120, 156

[56] References Cited

U.S. PATENT DOCUMENTS

| | | | |
|---|---|---|---|
| 4,389,012 | 6/1983 | Grikis et al. | 227/109 |
| 4,749,115 | 6/1988 | Fehrs | 227/109 |
| 4,815,647 | 3/1989 | Chou | 227/109 |
| 5,005,750 | 4/1991 | Scala | 227/109 |
| 5,522,533 | 6/1996 | Mukoyama et al. | 227/109 |
| 5,556,020 | 9/1996 | Hou | 227/109 |

*Primary Examiner*—Scott A. Smith
*Attorney, Agent, or Firm*—Morton J. Rosenberg; David I. Klein

[57] ABSTRACT

A nail magazine structure of a power nailer, including a nail magazine formed with multiple parallel nail head channels on inner face, an intermediate board fixed at a front end of the nail magazine, and a cover board mated with the nail magazine and formed with multiple nail head channels on inner face corresponding to the nail head channels of the nail magazine. A pushing plate is disposed between the nail magazine and the cover board for pushing the T-shaped nails. A preset length of rail is disposed along a rear section of a bottom end of the nail magazine for the cover board to slide back and forth, while a front section of the bottom end of the nail magazine is railfree and connected with the intermediate board, permitting the tips of the nails to protrude out of the nail magazine. The nail heads of different specifications of T-shaped nails are optionally positioned in different nail head channels so as to locate the tips of the nails at a higher or a lower position in the nail magazine.

2 Claims, 4 Drawing Sheets

PRIOR ART

NAIL MAGAZINE STRUCTURE OF A POWER NAILER

BACKGROUND OF THE INVENTION

The present invention relates to a nail magazine structure of a power nailer applicable to various specifications of T-shaped nails.

A power nailer serves to quickly hammer a T-shaped nail into a work piece by means of pneumatic or electric measure. FIG. 1 shows a conventional power nailer including a nail magazine 1 formed with multiple parallel nail head channels 11 on inner face. A cover board 2 mated with the nail magazine 1 is formed with multiple nail head channels 21 on inner face corresponding to the nail head channels 11 of the nail magazine 1. The cover board 2 has a pushing plate 22 forced by a spring (not shown). As shown in FIG. 2, a clearance S is defined between the cover board 2 and the nail magazine 1, whereby a row of T-shaped nails 12 can be placed in the clearance S. An intermediate board 34 is fixed at a front end of the nail magazine 1. The intermediate board 34 is formed with a nail head channel 31 passing through a front end and a rear end thereof. The intermediate board 34 is further formed with a nail striking channel 32 on one face and a stopper board 33 is locked on the face to form a nozzle 3.

The tips of the T-shaped nails 12 contact the inner bottom face of the nail magazine 1 with the nails 12 located and supported in the clearance S. Therefore, the rooms formed by the nail head channels 11 of the nail magazine 1 and the nail head channels 21 of the cover board 2 are only used to receive the nail heads of the T-shaped nails 12 without locating or supporting function.

Moreover, the bottom end of the nail magazine 1 is provided with a rail for the cover board 2 to slide along so that the tips of the T-shaped nails 12 cannot protrude out of the nail magazine 1. The specification of the T-shaped nails 12 is limited to that permitting the T-shaped nails 12 to be received in the nail magazine 1 and longer T-shaped nails cannot be used therein. This is quite inconvenient for an operator to work with the power nailer.

Furthermore, because the bottom end of the nail magazine 1 is provided with the rail and closed thereby, a thickness of the rail exists between the T-shaped nails 12 and the bottom end 35 of the intermediate board 34. Accordingly, in order to work in a recessed portion of the work piece, the tips of the T-shaped nails 12 must be located at a position farther from the bottom end 35 of the intermediate board 34 (the surface of the work piece). As a result, the travel of the T-shaped nails 12 striken by a hammer (not shown) will be relatively long. The relatively long travel will lead to deflection of the nails. For eliminating the problem of deflection, the nozzle 3 is designed with shorter length. This makes it difficult to nail in the recessed portion of the work piece.

SUMMARY OF THE INVENTION

It is therefore a primary object of the present invention to provide a nail magazine structure of a power nailer in which a front section of the bottom end of the nail magazine is railfree and open to the external space, so that the tips of the T-shaped nails are allowed to protrude out of the bottom end of the nail magazine. Therefore, the nail magazine is applicable to various specifications of T-shaped nails.

It is a further object of the present invention to provide the above nail magazine structure in which the distance between the tips of the nails and the bottom end of the intermediate board is reduced so as to shorten the travel of the nails and minimize the deflection thereof.

It is still a further object of the present invention to provide the above nail magazine structure in which the nozzle has a longer length from the bottom end of the nail magazine to the bottom end of the intermediate board in order to facilitate working in the recessed portion of the work piece.

The present invention can be best understood through the following description and accompanying drawing, wherein:

DETAILED DESCRIPTION OF THE PREFERRED EMBODIMENTS

Figure 3:
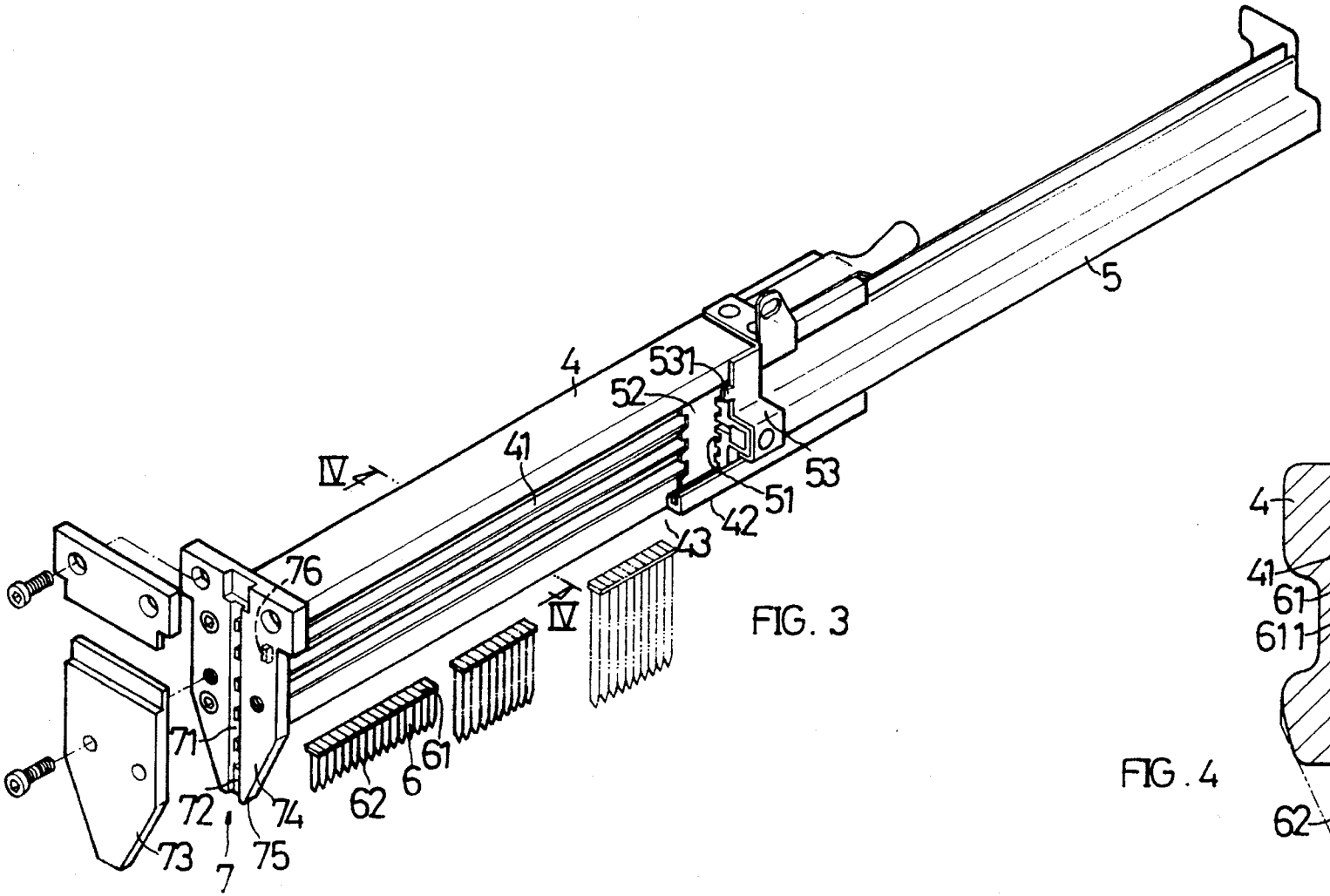
FIG. 3 is a perspective exploded view of a first embodiment of the present invention, showing that the T-shaped nails are loaded into the nail magazine.

Please refer to FIG. 3. The nail magazine structure of the present invention includes a nail magazine 4 formed with multiple parallel nail head channels 41 on inner face and a cover board 5 mated with the nail magazine and formed with multiple nail head channels 51 on inner face corresponding to the nail head channels 41 of the nail magazine 4. The cover board 5 has a pushing plate 52 forced by a spring (not shown) for defining a clearance P between the cover board 5 and the nail magazine 4, whereby a row of T-shaped nails 6 can be placed in the clearance P. An intermediate board 74 is fixed at a front end of the nail magazine 4. The intermediate board 74 is formed with a nail head channel 71 passing through a front end and a rear end thereof corresponding to the clearance P. The intermediate board 74 is further formed with a nail striking channel 72 on one face and a stopper board 73 is locked on the face, whereby the nail striking channel 72 and the stopper board 73 together define a passage for the T-shaped nails to longitudinally shift and form a nozzle 7.

A preset length of rail 42 is disposed along a rear section of a bottom end of the nail magazine 4 for the cover board 5 to slide back and forth. A railfree front section 43 of the bottom end of the nail magazine 4 is connected with the intermediate board 74, permitting a bottom end of the clearance P to communicate with external space. The cover board 5 is disposed with a pushing handle 53 facing the intermediate board 74 and a projection 531 is formed at a front end of the pushing handle 53. When the cover board 5 is pushed to cover the nail magazine 4, the projection 531 is inserted and located in a locating hole 76 of the intermediate board 74.

Figures 1, 2:
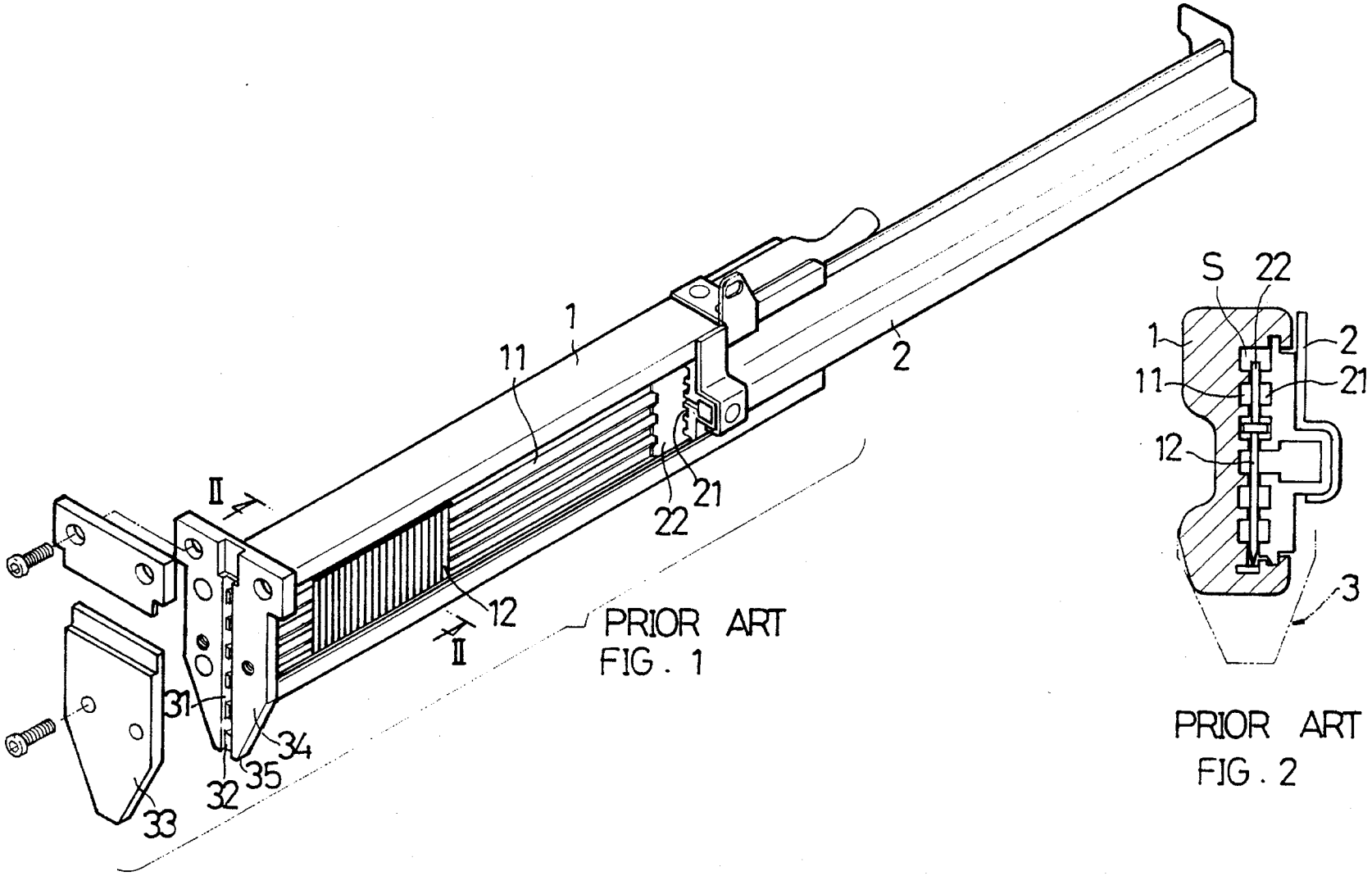
FIG. 2 PRIOR ART
FIG. 1 is a perspective exploded view of a conventional nail magazine structure of a power nailer.
FIG. 2 is a sectional view taken along line II—II of FIG. 1.
Figure 4:
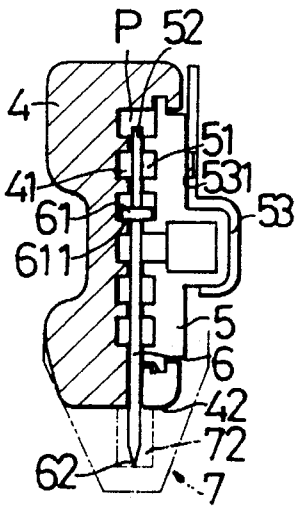
FIG. 4 is a sectional view taken along line IV—IV of FIG. 3.

Please refer to FIG. 4. Through the railfree section 43 of the nail magazine 4, the T-shaped nails 6 are placed in the clearance P with the nail heads 61 positioned in suitable nail head channels 41, 51. The bottom walls of the nail head channels 41, 51 contact with the bottom faces 611 of the nail heads 61 to support the same with the tips 62 of the nails 6 protruding outside the bottom end of the nail magazine 4.

According to the above arrangements, the nail magazine 4 of the present invention has the following advantages:

1. The nail magazine 4 is applicable to various specifications of T-shaped nails. Through the railfree front section 43 of the bottom end of the nail magazine 4, the tips 62 of the nails 6 protrude downward out of the nail magazine 4. In contrast, the conventional nail magazine 1 of the nailer is only applicable to the T-shaped nails 12 shorter than the distance between the top end and bottom end of the nail magazine 1. Therefore, apparently the present invention can be more widely used.

2. The travel is shortened and the deflection is reduced. Because the tips 62 of the T-shaped nails 6 protrude downward out of the bottom end of the nail magazine 4 and are as close to the bottom end 75 of the intermediate board 74 as possible, the travel of the tips 62 penetrating into the work piece is shortened and the deflection is reduced.

3. The nozzle is relatively long in order to facilitate working in a recessed portion. Because the front section 43 of the bottom end of the nail magazine 4 is railfree, the nozzle 7 extending from the bottom end of the nail magazine 4 to the bottom end 75 of the intermediate board 74 has a longer length and can be more conveniently operated in a recessed portion.

When loading the T-shaped nails 6, the nail head channels 41 of the nail magazine 4 are first faced upward and then the nail heads 61 of the nails 6 are placed in a suitable nail head channel 41. Thereafter, the pushing handle 53 of the cover board 5 is manually pushed to slide along the rail of the top end of the nail magazine 4, making the nail heads 61 of the nails 6 enter the corresponding nail head channel 51 of the cover board 5. Although only the rear section of the bottom end of the nail magazine 4 is provided with the rail 42, the nail head channels 41, 51 are parallel to the rail of the top end of the nail magazine 4. Therefore, when manually pushed, the cover board 5 is guided by the nail heads 61 of the T-shaped nails 6 and prevented from deflecting. Finally, the projection 531 of the pushing handle 53 is inserted and located in the locating hole 76 of the intermediate board 74 so as to fix the cover board 5 without deflection.

Figure 5B:
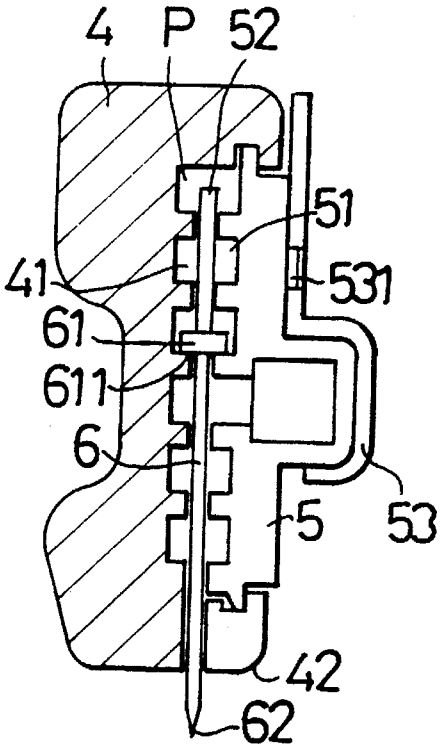
FIGS. 5A and 5B respectively show the relationship between the T-shaped nails and the nail head channels of the conventional nail magazine and the first embodiment of the present invention.
Figure 5A:
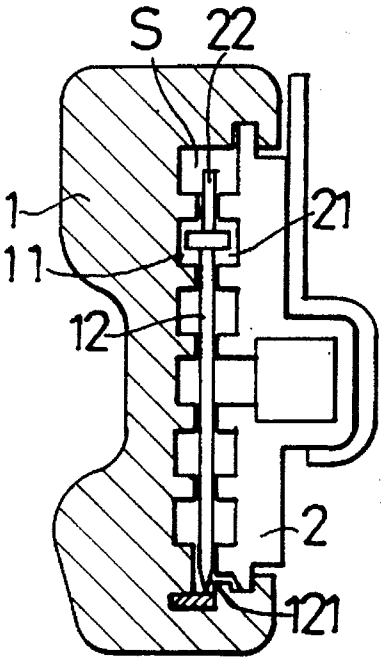

Please refer to FIG. 5A. In the conventional nail magazine 1, the tips 121 of the T-shaped nails 12 contact with the bottom end of the nail magazine 1 so that the nail head channels 11, 21 only serve to receive the nail heads without guiding effect. In contrast, as shown in FIG. 5B, the bottom end of the nail magazine 4 of the present invention is railfree and open to the external space, the tips 62 of the T-shaped nails 6 are allowed to naturally suspend and protrude outside the bottom end of the nail magazine 4. Therefore, the bottom walls of the nail head channels 41, 51 contact with the bottom faces 611 of the nail heads 61 and support the same. Accordingly, the nail heads 61 can be optionally placed in suitable nail head channels 41, 51 with the tips 62 protruding out of the bottom end of the nail magazine 4 and being as close to the bottom end 75 of the intermediate board 74 as possible so as to shorten the travel.

Figure 6A:
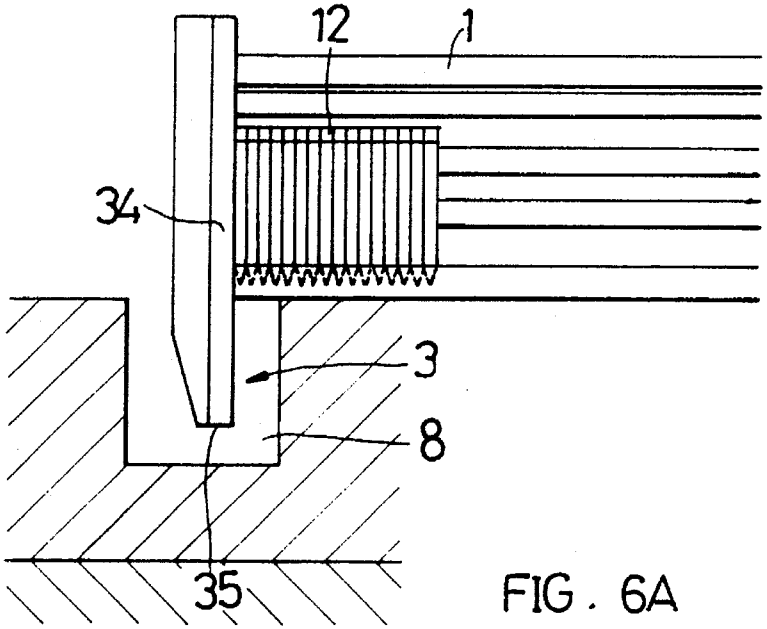
FIGS. 6A and 6B respectively show the use of the conventional nail magazine and a second embodiment of the present invention in a recessed portion.

Please refer to FIG. 6A. In conventional nail magazine 1, the bottom end thereof is provided with a rail for the cover board 2 to slide therealong. The thickness of the rail shortens the distance between the bottom end of the nail magazine 1 and the bottom end 35 of the intermediate board 34 so that the nozzle 3 has a relatively short length and it is difficult for the nozzle 3 to contact and work in a recessed portion 8 of the work piece. In contrast, as shown in FIG. 6B, according to a second embodiment of the present invention, the railfree front section 43 of the nail magazine 4 of the present invention enables the nozzle 7 to have a relatively long length for easily extending into the recessed portion 8 and performing the nailing operation.

Figure 6B:
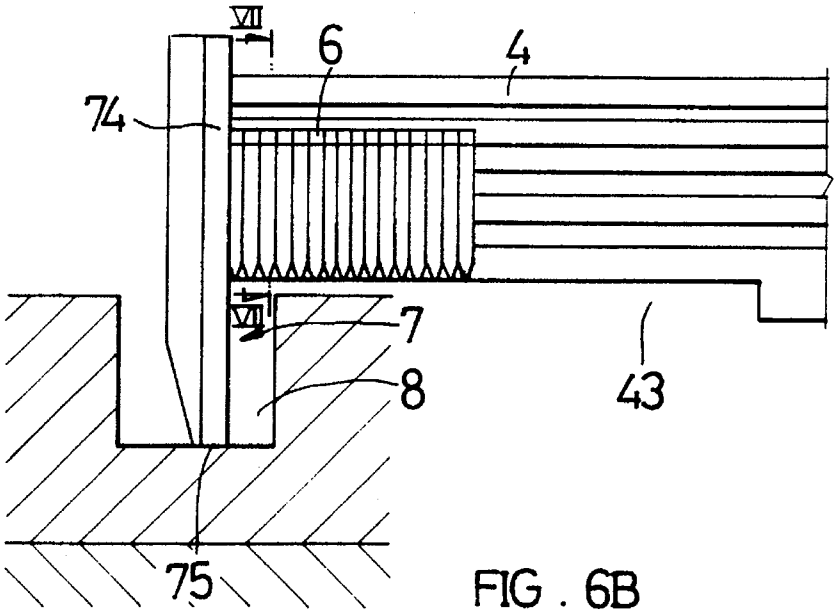
Figure 7:
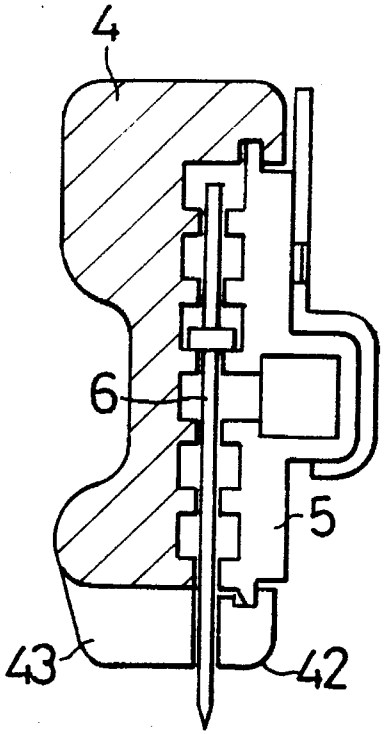
FIG. 7 is a sectional view taken along line VII—VII of FIG. 6.

FIG. 7 shows the second embodiment of the present invention, in which the length of a front section of the nail magazine 4 opposite to the railfree section 43 thereof is shortened in accordance with the railfree section 43, so that the nozzle 7 can be even more conveniently operated in the recessed portion 8 as shown in FIG. 6B.

In conclusion, when working in the recessed portion 8, the nozzle 7 call be fully extended into the recessed portion 8 to strike the T-shaped nails 6 into the work piece without consideration of the possibility of deflection. Therefore, the tips of the nails 6 can be positioned inside the nail magazine 4 without protruding out of the bottom end thereof. When working with a work piece having relatively small area and the possibility of deflection must be considered, the tips of the nails 6 must be as close to the bottom end 75 of the intermediate board 74 as possible so as to minimize the deflection. Accordingly, depending on different requirements of the work pieces (working in recessed portion or minimized deflection), the nail heads of the T-shaped nails are positioned in different nail head channels so as to locate the tips of the nails at a higher or a lower position in the nail magazine.

It is to be understood that the above description and drawings are only used for illustrating some embodiments of the present invention, not intended to limit the scope thereof. Any variation and derivation from the above description and drawings should be included in the scope of the present invention.

What is claimed is:

1. A nail magazine structure of a power nailer, comprising a nail magazine formed with multiple parallel nail head channels on an inner face and a cover board mated with the nail magazine and formed with multiple nail head channels on an inner face corresponding to the nail head channels of the nail magazine, the cover board having a pushing plate forced by a spring for defining a clearance between the cover board and the nail magazine, whereby a row of T-shaped nails are placed in the clearance, an intermediate board being fixed at a front end of the nail magazine, the intermediate board being formed with a nail head channel passing through a front end and a rear end thereof corresponding to the clearance, the intermediate board being further formed with a nail striking channel on one face, a stopper board being locked on the face, said nail magazine structure further comprising a preset length of rail being disposed along a rear section of a bottom end of the nail magazine for the cover board to slide back and forth thereon, a front section of the bottom end of the nail magazine being railfree and connected with the intermediate board, permitting the clearance to communicate with external space, the nail heads of the T-shaped nails being supported by the nail head channels, said rail having a length substantially less than a length of said magazine.

2. A nail magazine structure as claimed in claim 1, wherein a projection is formed at a front end of the cover board and when the cover board covers the nail magazine, the projection is inserted and located in a locating hole of the intermediate board.

* * * * *